United States Patent [19]

Rogers, Jr.

[11] Patent Number: 4,758,044

[45] Date of Patent: Jul. 19, 1988

[54] ROCKING CHAIR

[75] Inventor: Walter C. Rogers, Jr., Denton, N.C.

[73] Assignee: Parma Corporation, Denton, N.C.

[21] Appl. No.: 42,853

[22] Filed: Apr. 27, 1987

[51] Int. Cl.[4] ..... A47C 3/027

[52] U.S. Cl. ..... 297/265; 248/372.1; 248/583; 297/259; 297/261; 297/329

[58] Field of Search ..... 297/258, 259, 264–267, 297/321, 329, DIG. 7; 248/371, 372.1, 582–585

[56] References Cited

U.S. PATENT DOCUMENTS

| | | | |
|---|---|---|---|
| 465,719 | 12/1891 | Mitchell | 297/266 X |
| 667,967 | 2/1901 | Bunker | 297/266 X |
| 2,529,638 | 11/1950 | Spradler | 297/329 |
| 3,333,811 | 8/1967 | Matthews | 248/584 X |
| 4,372,606 | 2/1983 | Faull | 297/258 X |

*Primary Examiner*—Kenneth J. Dorner
*Assistant Examiner*—Peter R. Brown
*Attorney, Agent, or Firm*—William E. Mouzavires

[57] ABSTRACT

A rocking chair having a fixed base, and a seat frame mounted on the base for rocking movement by means of a plurality of rocker cams mounted one behind the other. The rocker cams are pivotally mounted to one of the base or seat frame and having arcuate surfaces engaged against the other of the base or seat frame. This achieves a predetermined desired motion of the seat relative to the base. In one embodiment, a pair of such rocking cams are provided in tandem on each side of the chair. In another embodiment, only a single pair of cams are provided in tandem at a central portion of the chair. In another embodiment three cams are provided in a triangular arrangement.

19 Claims, 2 Drawing Sheets

ROCKING CHAIR

BACKGROUND OF INVENTION

One typical rocking chair of the prior art includes a pair of rocking cams mounted in side-by-side relationship on opposite sides of the chair respectively. The cams are rigidly fixed to the seat frame and have arcuate surfaces engaged against a fixed base with tension springs located between the cams and the base to impose a constant bias on the cams. The cams are rockable along an arcuate path determined by the shape of the cam surface which engages the base. Such a rocker is shown by way of example in U.S. Pat. No. 3,730,585. While the cam construction of these types of rockers have the advantage of simplicity, the rocking motion of the seat including the path of movement of the seat is governed by the shape of the cams which, at times, can produce undesirable forward or rearward lurching movement at the extremes of travel.

Another type of rocking chair utilizes linkage mechanisms to provide rocking as well as translatory movement of the seat relative to the base to achieve a different type motion similar to a glider chair. Such a chair is shown, for example, in U.S. Pat. Nos. 4,536,029 and 4,544,201. While the use of linkages enable a predetermined rocking and gliding motion to be achieved, they are more complicated when compared to the conventional cam assemblies described above. They also suffer from instability in the side-to-side direction of the chair thus requiring torque tubes to overcome this drawback.

OBJECTS OF THE PRESENT INVENTION

The present invention seeks to provide yet another type of motion to a rocker which is believed to have certain advantages over the conventional cam rockers and linkage gliders of the prior art and which, at the same time, does not require complicated linkage mechanisms.

Another object of the present invention is to provide a rocking-type chair having a novel mechanism for imparting motion to the seat of the chair relative to a fixed base or datum. Included herein is a novel mechanism for mounting a seat to a base to provide a predetermined motion to the seat relative to the base.

Another object of the present invention is to provide a novel linkage mechanism for imparting a predetermined motion and seat-balance to a rocking-type chair. Included herein is such a mechanism that may be designed in a variety of ways to achieve different types of predetermined motion as desired.

A further object of the present invention is to provide a novel rocking chair whose seat will achieve a predetermined motion including rocking and translatory motion relative to a fixed base.

Another object of the present invention is to provide a rocking chair which utilizes rocker cams in a simple linkage arrangement to mount the seat relative to a fixed base.

A still further object of the present invention is to provide a motion mechanism for a rocker-type chair that is relatively simple and economical in construction and may be easily incorporated in various styles of chairs including recliner chairs.

SUMMARY OF INVENTION

In summary, the present invention, according to a preferred embodiment, is a motion mechanism including two rocker cams located one behind the other between a seat and a base with the rocking surfaces of the cams engaged against one of the seat and base while being movably connected to the other of the seat and base to be movable relative thereto.

DRAWINGS

Other objects and advantages will become apparent from the following more detailed description of the attached drawings in which.

DETAILED DESCRIPTION

Figure 1:
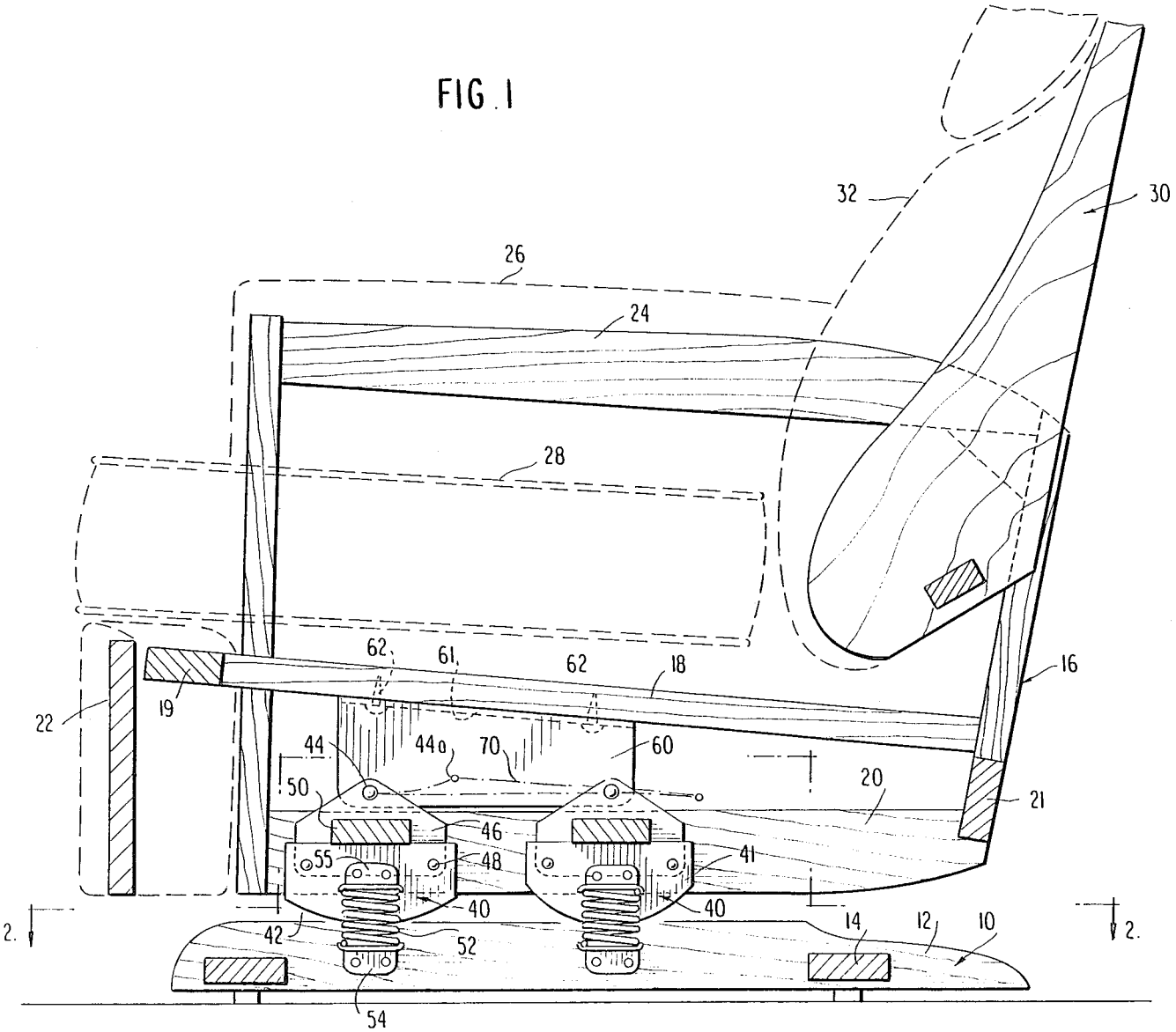
FIG. 1 is a side elevational view of a rocker-type chair incorporating a preferred embodiment of the present invention with parts shown in cross section.
Figure 2:
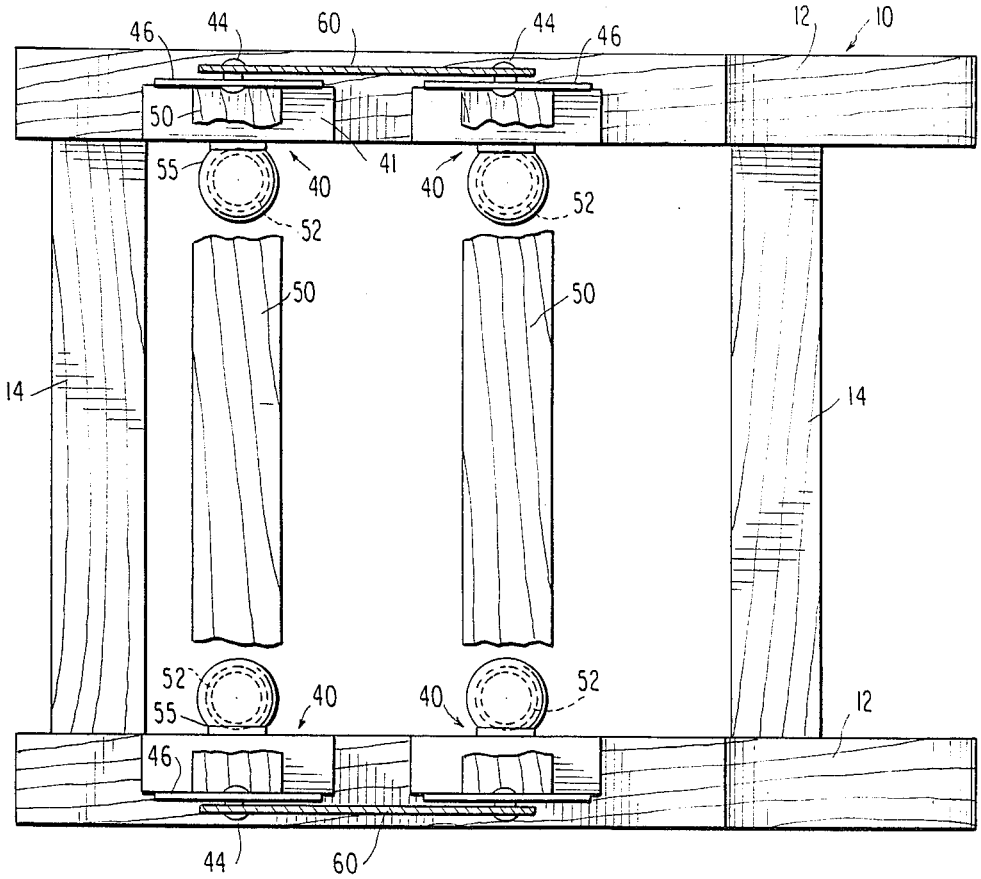
FIG. 2 is a cross-sectional view taken generally along lines 2—2 of FIG. 1.

Referring to the drawings in detail, there is shown in FIGS. 1 and 2 for illustrative purposes only, a rocking-type chair incorporating a preferred embodiment of the present invention. The chair may have conventional frame and upholstery constructions including a base generally designated 10 comprised of opposite side rails 12 interconnected by cross rails 14. The frame of the seat which is generally designated 16 includes upper and lower side rails 18 and 20 and crossrails 19 and 21. A front crosspiece is also provided as are armrests 24. A seat cushion is designated by 28 while the upholstery of the seat frame is designated by 26. The chair also includes a backrest generally designated 30 having upholstery 32.

In accordance with the present invention, the seat 16 is mounted to the base 10 by a novel mechanism including a pair of cam assemblies 40 located one behind the other between the seat and the base. In the preferred embodiment shown in FIGS. 1 and 2, there are two cam assemblies 40 provided in tandem on each of the opposite sides of the base as shown in FIG. 2.

As shown in FIG. 1, the cam assemblies each include a cam 41 having an arcuate rocking surface 42 which, in the preferred embodiment, is at its lower end and engaged against the base rail 12. The upper end of the cam in the preferred embodiment is pivoted by a pivot pin 44 to the seat frame. In the preferred embodiment shown, the seat frame is provided with a metal bracket 60 to which the cam is pivoted at 44 by a pivot pin. Bracket 60 has a horizontal flange 61 fixed by screws 62 to the lower rail 18 of the seat frame. In one specific construction, the cam may be made from a wooden block which includes the rocking surface 42; and a vertical plate 46 fixed to one side of the block by fasteners 48. Pivot pin 44 is received through the upper end of plate 46. Moreover, the cam assemblies on opposite sides of the chair are integrated through a cross bar fixed to and between the cams.

Each cam 41 is biased to the normal position shown in FIG. 1 by means of tension coil springs 52 secured between brackets 54 and 55 fixed respectively to base rail 12 and cam 41 in conventional manner. It will be understood that springs 52 are constantly under tension and bias the cams and seat to the normal upright position shown in FIG. 1.

Although in the preferred embodiment shown in FIGS. 1 and 2, the cams 41 are arranged with their rocking surfaces 42 engaged against the base, in an alternative embodiment not shown, one or both of the rocking surfaces may be disposed at the upper ends of the cams in engagement with the seat frame and with one or both of the lower ends of the cams pivoted to the base.

In operation of the chair, when the seat is rocked backwardly (for example) on the rocking surfaces 42 of the cams, the seat frame will pivot relative to the cams 41 and undergo translatory movement in the rearward direction relative to the base as well as rocking movement. During such motion, the pivot pin 44 may move along the phantom line illustrated in FIG. 1 to the position designated by 44*a*. Such motion provides a desirable arc of travel of the seat which arc is of suitable length and pitch or radius of curvature so as to provide smooth rocking motion free of lurching movement at the opposite extremes of travel. Moreover, the present invention allows various types of desirable motion or rocking balance of the seat to be achieved simply by choosing the appropriate radius of curvature of the rocking surfaces; or the spacing between the cams on each side of the chair; or the elevation of the pivot or mounting point (44) of the cams. A variation in any one of these factors will effect the motion of the seat. Moreover, the radii of curvature of the rocking surfaces 42 may be varied within each associated pair of cams to provide desired motion. For example, in the embodiment shown in FIG. 1, the rocking surfaces 42 of the front cams may have a radius of curvature of $1\frac{3}{4}''$ and the rocking surfaces of the rear cams a radius of curvature of $1\frac{3}{8}''$. It will be appreciated that the two cam assemblies 40, together with the seat frame 16 and base 10, comprise, in effect, a "four bar" linkage but wherein two of the bars are flexible to allow predetermined path of movement to be achieved by the seat frame. Although the cams 41 may be pivoted to either the seat frame as at 44 or the base (not shown), other types of movable or flexible connections may be utilized in order to achieve a desired type of motion.

Figure 3:
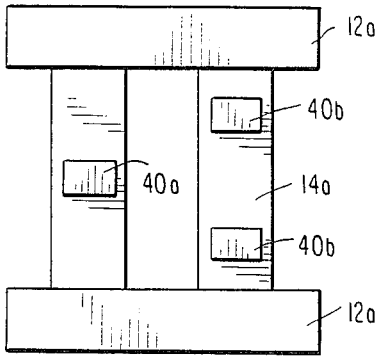
FIGS. 3 and 4 are diagrammatic plan views of second and third embodiments of the present invention.
Figure 4:
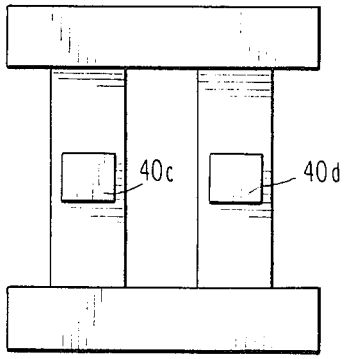

Other types of cam arrangements may also be employed in keeping with the present invention. Note, for example, FIG. 3 wherein a triangular arrangement is shown in which one cam assembly 40*a* is located at a central portion of the base at the forward end thereof with two cam assemblies 40*b* located behind cam assembly 40*a* on opposite side portions of the chair. The side and crossrails of the base are designated 12*a* and 14*a* respectively. In FIG. 4 only two cam assemblies 40*c* and 40*d* are employed, one aligned behind the other along a central axis of the chair.

What is claimed is:

1. A rocking chair including a base, a seat frame above the base and means mounting the seat frame on the base for rocking movement, said means including at least two cams located forwardly and rearwardly of the chair relative to each other, each cam including a convex arcuate rocking surface engaged against for travel along one of said base and seat frame while being pivotally connected to the other of said base and seat frame to be movable relative thereto.

2. The rocking chair defined in claim 1 including two pairs of said cams located respectively on opposite side portions of the chair with the cams of each pair located in tandem relative to each other.

3. The rocking chair defined in claim 1 including three of said cams located in a generally triangular arrangement relative to each other.

4. The rocking chair defined in claim 1 wherein said cams are located along a central portion of the chair.

5. The rocking chair defined in claim 1 including biasing means yieldingly urging each cam to a normal position.

6. The rocking chair defined in claim 5 wherein said biasing means is connected to said one of said base and seat frame.

7. The rocking chair defined in claim 1 wherein each cam is pivotally connected to the seat frame and has its rocking surface engaged on the base.

8. The rocking chair defined in claim 1 wherein each cam is movably connected to both of said base and seat frame.

9. The rocking chair defined in claim 8 including spring means respectively connecting said cam to said one of said base and seat frame.

10. The rocking chair defined in claim 1 wherein the rocking surfaces of said cams have different radii of curvature.

11. The rocking chair defined in claim 1 further including a link fixed to said other of said base and seat frame and wherein said cams are pivotally connected to said link.

12. The rocking chair defined in claim 11 wherein said link is fixed to said seat frame with said rocking surfaces of said cams engaged against said base.

13. The rocking chair defined in claim 1 wherein said cams are each blocks having a longitudinal dimension extending in a forward-rearward direction of the chair.

14. A motion chair including in combination, a base, a seat, and linkage means connected to and between the seat and the base for mounting the seat on the base for rocking and translatory movement relative to the base, said linkage means including a four bar linkage including a cam having a convex arcuate rocking surface engaged against for travel along one of said seat and base, and a link connecting the cam and said one of said seat and base, said cam being pivotally connected to the other of said seat and base such that the other of said seat and base and said cam are movable relative to each other.

15. The motion chair defined in claim 14 wherein said link comprises a spring connected to the cam and said one of the base and seat.

16. A motion mechanism for mounting a seat to a base, the mechanism comprising in combination, a pair of cams arranged one behind the other and having upper and lower end portions, said cams having on one end portions thereof convex arcuate bearing surfaces, and a link pivotally interconnecting the cams at the other end portions thereof, said link adapted to be fixed to one of a seat and base of an associated motion chair with the bearing surfaces engaged against the other of the seat and base for travel along the same.

17. The mechanism defined in claim 16 further including at least one flexible link member connected to one of the cams and adapted to be connected to one of said base and seat of the chair.

18. The mechanism defined in claim 17 further including a second flexible link member connected to the other of the cams and adapted to be connected to one of said base and seat of the chair.

19. The mechanism defined in claim 16 wherein said bearing surfaces of said cams have different radii of curvature.

* * * * *